US011425489B2

(12) United States Patent
Childs

(10) Patent No.: US 11,425,489 B2
(45) Date of Patent: Aug. 23, 2022

(54) PASSIVE RADIATOR AND LOUDSPEAKER SYSTEM

(71) Applicant: Goertek Inc., Shandong (CN)

(72) Inventor: Michael Childs, Shandong (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 16/904,662

(22) Filed: Jun. 18, 2020

(65) Prior Publication Data

US 2021/0006891 A1 Jan. 7, 2021

Related U.S. Application Data

(60) Provisional application No. 62/870,097, filed on Jul. 3, 2019.

(51) Int. Cl.
*H04R 1/28* (2006.01)
*H04R 1/02* (2006.01)

(52) U.S. Cl.
CPC ..... *H04R 1/2834* (2013.01); *H04R 1/025* (2013.01)

(58) Field of Classification Search
CPC ..... H04R 1/2834; H04R 1/025
USPC ..... 381/345
See application file for complete search history.

(56) References Cited

U.S. PATENT DOCUMENTS

2004/0188175 A1* 9/2004 Sahyoun ..... H04R 9/041 181/157
2005/0157900 A1 7/2005 Litovsky et al.
2016/0353198 A1* 12/2016 Sahyoun ..... H04R 1/2834

* cited by examiner

*Primary Examiner* — Sean H Nguyen
(74) *Attorney, Agent, or Firm* — Baker Botts, LLP

(57) ABSTRACT

A passive radiator and a loudspeaker system are provided. The passive radiator comprises: a radiating surface with geometry providing two surfaces with vertical separation, which are a first surface and a second surface; a primary suspension element, one end of which is connected to the first surface of the radiating surface; and a secondary suspension element, one end of which is connected to the second surface of the radiating surface.

6 Claims, 4 Drawing Sheets

PASSIVE RADIATOR AND LOUDSPEAKER SYSTEM

CROSS-REFERENCE TO RELATED APPLICATION

This application claims priority to US Provisional Utility Patent Application No. 62/870,097, filed on Jul. 3, 2019, which is hereby incorporated by reference in its entirety.

FIELD OF THE INVENTION

The present disclosure relates to a passive radiator, and more specifically, to a passive radiator and a loudspeaker system.

BACKGROUND OF THE INVENTION

A passive radiator is a radiating surface which is mounted alongside a loudspeaker into a sealed enclosure. A passive radiator is similar to the loudspeaker in that it has a cone and suspension elements, but it has no voice coil and magnet system. The variation of sound pressure inside the sealed enclosure caused by the loudspeaker will excite the passive radiator into vibration. At low frequencies, the radiated energy from the passive radiator couples constructively with the energy radiated from the loudspeaker and this will extend the bass response of the loudspeaker system.

A passive radiator would traditionally have a cone, a frame and two suspension elements. One of the suspension elements is a surround connecting the outer edge of the cone to the top of the frame and another suspension element is a suspension piece connecting the inner edge of the cone and a dust cap to the bottom of the frame. The height of the passive radiator is defined by the depth of the cone and the height of frame. In another implementation, a passive radiator has only one suspension element, which is a surround attached to the outer edge of a flat radiating surface, and the frame and the suspension piece are removed.

FIG. 1 shows a passive radiator having two suspension elements. As shown in FIG. 1, the passive radiator has a surround 11, a suspension piece 12, a cone 13, a frame 14 and a dust cap 15. The surround 11 connects the outer edge of the cone 13 to the top of the frame 14. The suspension piece 12 connects the inner edge of the cone 13 and the dust cap 15 to the bottom of the frame. This passive radiator has a relatively high profile.

FIG. 2 shows another passive radiator having only one suspension element. As show in FIG. 2, the passive radiator has a flat radiating surface 22 and one surround 21. The surround 21 suspends or supports the flat radiating surface 22.

The passive radiator shown in FIG. 2 is not stable because of only one surround 21 for suspending the flat radiating surface 22. The vibration structure is unstable and can cause the flat radiating surface to "rock", which can cause performance issues to the passive radiator. The performance will also rely on the material properties and geometry of the surround, which can limit the freedom of design such as radiator parameters.

SUMMARY OF THE INVENTION

An objective of this disclosure is to provide a new passive radiator.

According to a first aspect of the present invention, there is provided a passive radiator, comprising: a radiating surface with geometry providing two surfaces with vertical separation, which are a first surface and a second surface; a primary suspension element, one end of which is connected to the first surface of the radiating surface; and a secondary suspension element, one end of which is connected to the second surface of the radiating surface.

According to a second aspect of the present invention, there is provided loudspeaker system, comprising: an enclosure; a loudspeaker mounted in a first surface of the enclosure; and at least one passive radiator according to an embodiment, which is mounted in a second surface of the enclosure.

According to various embodiment of this disclosure, a low profile of a passive radiator can be provided while its stability can be maintained.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
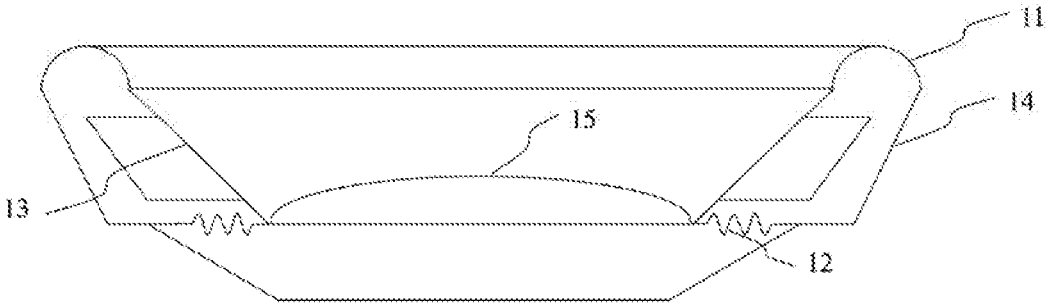
FIG. 1 (Prior Art)
FIG. 1 schematically shows a prior art passive radiator.
Figure 2:
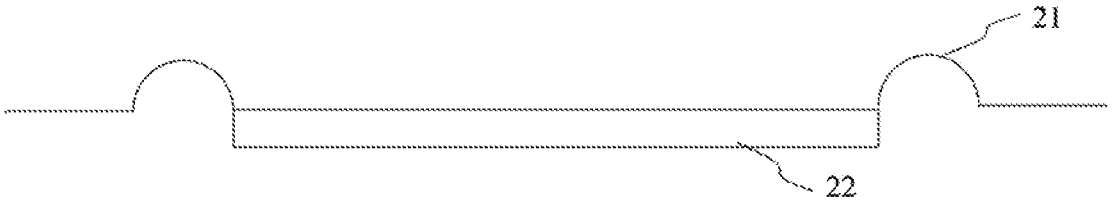
FIG. 2 (Prior Art)
FIG. 2 schematically shows another prior art passive radiator.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

In this disclosure, a passive radiator is proposed. The passive radiator comprises: a radiating surface, a primary suspension element and a secondary suspension element.

The radiating surface with geometry providing two surfaces with vertical separation, which are a first surface and a second surface. This radiating surface is a surface which could vibrate under the excitation of a loudspeaker. It could be the stiffener component. The radiating surface provide a vertical separation geometry. In this regard, the radiating surface has the first surface and the second surface, which are separated in vertical direction. That is, a suspension element amounted on the first surface will not block the movement of another suspension element on the second surface. The radiating surface could be a low profile surface or a flat surface.

One end of the primary suspension element is connected to the first surface of the radiating surface; and one end of the secondary suspension element is connected to the second surface of the radiating surface. For example, the inner diameter edge of the primary suspension element is connected to a first or upper surface of the radiating surface. The inner diameter edge of the secondary suspension element is connected to a second or lower surface of the radiating surface.

The suspension elements are not limited to the primary and secondary suspension elements. Further suspension element can be used to provide even stronger support to the radiating surface of the passive radiator and further enhance the stability of the radiating surface.

In a simplest situation, the radiating surface provides a vertical separation by its thickness and the first and second surfaces are its upper and lower surfaces. However, the number of surfaces provided by the radiating surface for connecting the suspension elements is not limited to two and could be more than two. For example, in a step structure or a trench structure with steps, it can provide more than two connecting surfaces.

Here, the radiating surface, which per se could provide a vertical separation, is used so that at least two suspension elements could be connect to it and the stability could be maintained. Furthermore, the radiating surface could be a low profile surface or a flat surface, so that the overall profile of a passive radiator can be reduce. This kind of low profile passive radiator can save room in a loudspeaker system, and the size of the loudspeaker system can be lowered.

The passive radiator can further comprise an assembly ring. The other end of the primary suspension element is connected to the assembly ring so that it is able to be connected to the enclosure through the assembly ring, and the other end of the secondary suspension element is also connected to the connecting ring so that it is able to be connected to the enclosure through the assembly ring. As such, the passive radiator can be assembled and sealed to an enclosure of a loudspeaker system. The outer diameter edge of the first suspension element can be connected to an upper portion of the assembly ring, and the outer diameter of the secondary suspension element can be connected to a lower portion of the assembly ring. As such, a compact and stable passive radiator module could be provided.

The radiating surface may have a separation structure at its edge portion, which provides a vertical separation of the primary and secondary suspension elements. In this regard, a designer has a freedom of designing the body of the radiating surface, and thus the separation structure has minimum influence on the performance of the passive radiator.

The low profile passive radiator is advantageous. For example, in a loudspeaker system, a loudspeaker is mounted on the front face of its enclosure and the dimensions of the frond face are not large enough to mount any number of passive radiators, the radiating surface area of which should be large enough for effectiveness. The passive radiators would have to be mounted on the side faces of the enclosure where the depth of the loudspeaker will limit the available depth for the passive radiators. In another example, a loudspeaker system has a long thin enclosure, for example a sound bar enclosure, where a number of passive radiators will be mounted on the long surfaces of the enclosure to achieve an effective radiating surface area. The small depth and height dimensions of the enclosure would limit the useable depth for the passive radiator. The low profile passive radiator disclosed here will be suitable for these applications.

As explained above, a step structure or a trench structure can provide such a vertical separation. Embodiments with such structures will be described with reference to FIGS. 3-8. In the embodiments of FIGS. 3-8, the radiating surface is flat and could be a stiffener. The suspension elements such as surround can be attached directly to the stiffener.

Figure 3:
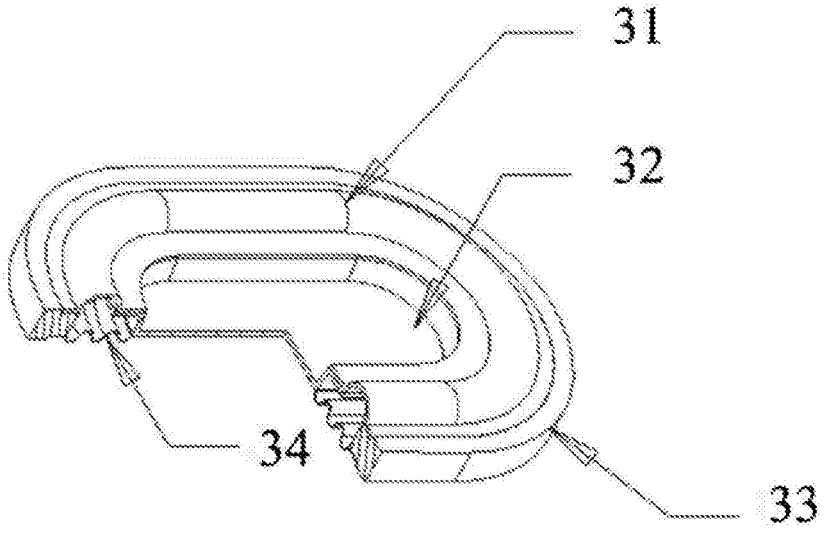
FIG. 3 schematically shows a perspective view of a passive radiator according to an embodiment of this disclosure.
Figure 4:
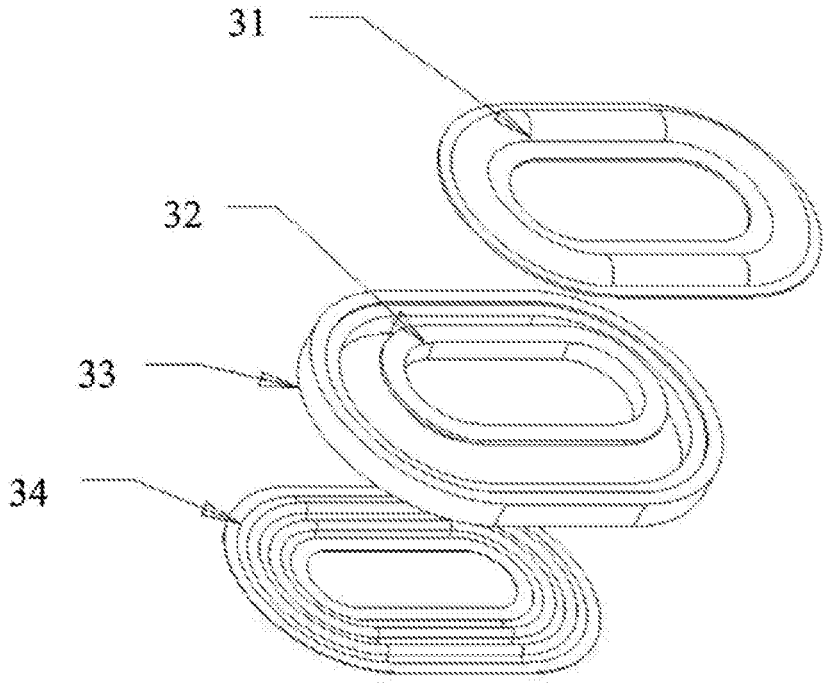
FIG. 4 schematically shows an explosive view of the passive radiator of FIG. 3.
Figure 5:
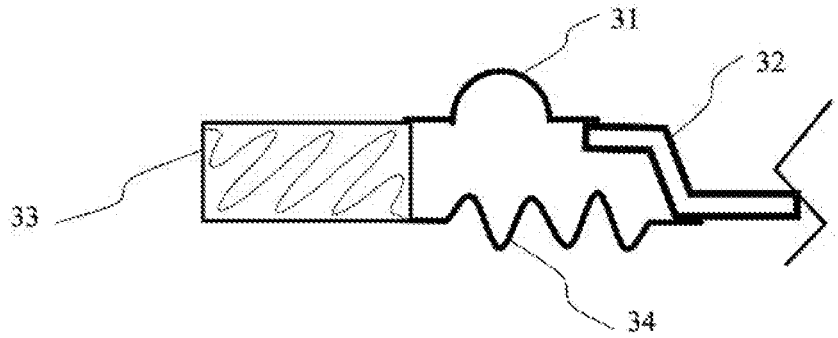
FIG. 5 schematically shows a detailed view of the passive radiator of FIG. 3.

FIG. 3 schematically shows a perspective view of a passive radiator according to an embodiment of this disclosure. FIG. 4 schematically shows an explosive view of the passive radiator of FIG. 3. FIG. 5 schematically shows a detailed view of the passive radiator of FIG. 3.

As shown in FIG. 3, the passive radiator has a primary suspension element 31 such a surround, a radiating surface 32, an assembly ring 33 and a secondary suspension element 34. FIG. 4 shows the explosive view of the components of the passive radiator. FIG. 5 shows the details of the step structure at the edge of the radiating surface. As shown in FIGS. 3 and 5, the step structure is provided at the edge of the radiating surface 32. An inner diameter edge of the primary suspension element 31 is connected to an upper level of the step structure on the first surface, and an inner diameter edge of the secondary suspension element 34 is connected to a lower level of the step structure on the second surface. The outer diameter edges of the primary suspension element 31 and the secondary suspension element 34 are connected to the assembly ring 33.

Figure 6:
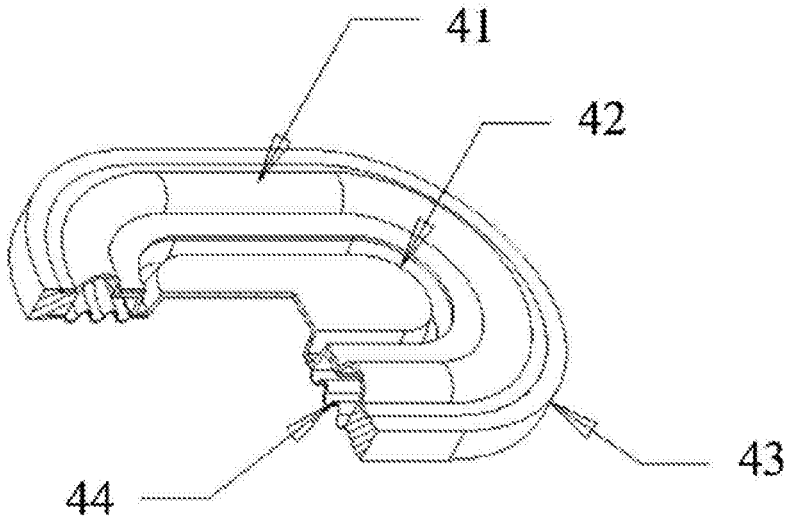
FIG. 6 schematically shows a perspective view of a passive radiator according to another embodiment of this disclosure.
Figure 7:
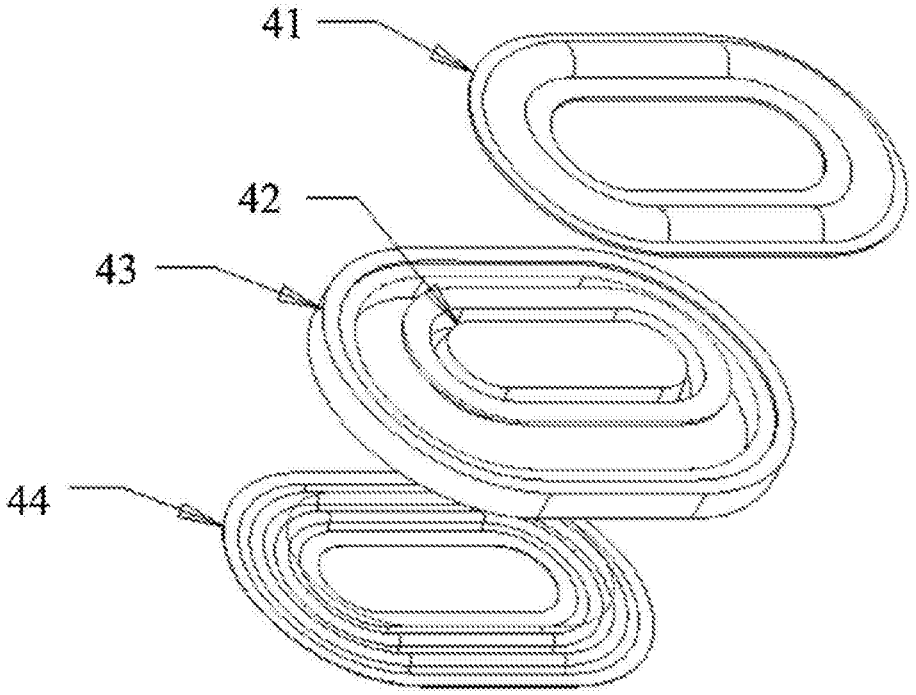
FIG. 7 schematically shows an explosive view of the passive radiator of FIG. 6.
Figure 8:
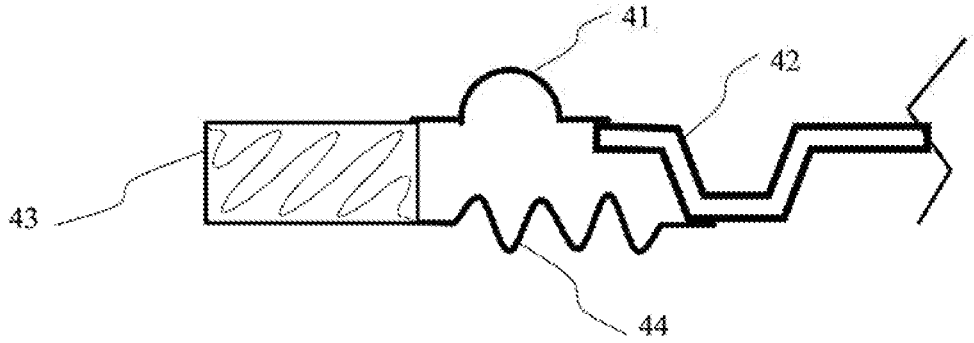
FIG. 8 schematically shows a detailed view of the passive radiator of FIG. 6.

FIG. 6 schematically shows a perspective view of a passive radiator according to another embodiment of this disclosure. FIG. 7 schematically shows an explosive view of the passive radiator of FIG. 6. FIG. 8 schematically shows a detailed view of the passive radiator of FIG. 6.

As shown in FIG. 6, the passive radiator has a primary suspension element 41 such a surround, a radiating surface 42, an assembly ring 43 and a secondary suspension element 44. FIG. 7 shows the explosive view of the components of the passive radiator. FIG. 8 shows the details of the trench structure at the edge of the radiating surface. As shown in FIGS. 6 and 8, the trench structure is provided at the edge of the radiating surface 42. The inner diameter edge of the primary suspension element 41 is connected to an upper edge of the trench structure on the first surface, and an inner diameter edge of the secondary suspension element 44 is connected to a bottom of the trench structure on the second surface. The outer diameter edges of the primary suspension element 41 and the secondary suspension element 44 are connected to the assembly ring 43.

In the trench structure, the body of the radiating surface will not go inside the enclosure of the loudspeaker system, and will make more room for the sound energy coupling. In this regard, it will provide a better performance.

As discussed above, the trench structure may also have a step structure on it outer side wall so that more suspension elements could be connected to the radiating surface and provide even stronger support to the radiating surface of the passive radiator.

Figure 9:
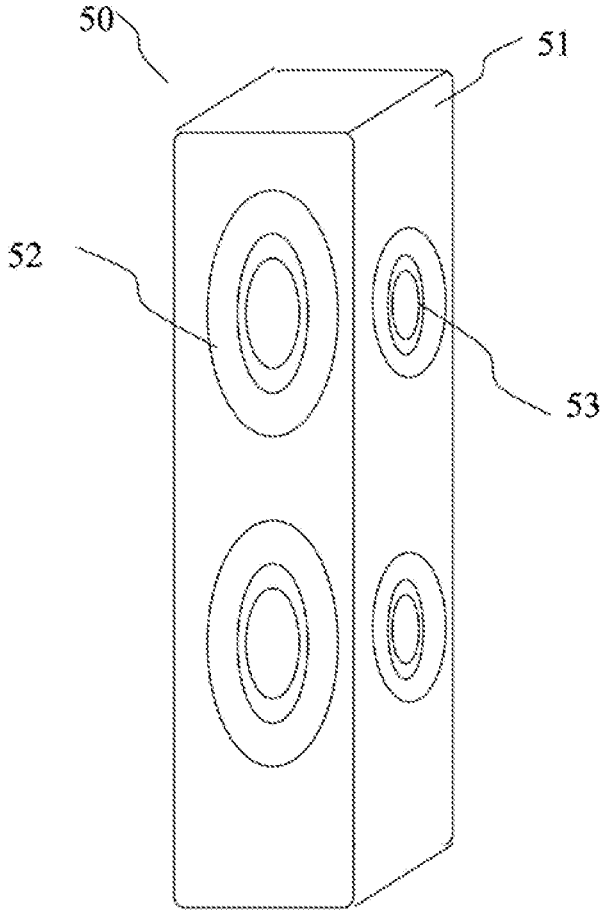
FIG. 9 schematically shows a loudspeaker system according to an embodiment.

FIG. 9 schematically shows a loudspeaker system according to an embodiment. As shown in FIG. 9, the loudspeaker system 50 comprises: an enclosure 51; a loudspeaker 52 mounted in a first surface of the enclosure 51; and at least one passive radiator 53 mounted in a second surface of the enclosure 51. The passive radiator 53 can be any of those described above. In FIG. 9, the first surface is a front surface of the enclosure 51 and the second surface is a side surface of the enclosure 51.

Although it is shown in FIG. 9 that the loudspeaker 52 is mounted on the front face of the enclosure 51 and the passive radiator 53 is mounted on the side face of the enclosure 51 that is different from the front face, they can be mounted on the same face, such as front face.

As shown in FIG. 9, the enclosure is of a long thin shape and it includes a plurality of passive radiators 53. The plurality of passive radiators are mounted in the long surface of the enclosure. For example, the enclosure 51 is a sound bar.

It is advantageous to use these passive radiators in the loudspeaker system like that of FIG. 9. They are stable and could provide a good performance while saving room of the enclosure.

Although some specific embodiments of the present invention have been demonstrated in detail with examples, it should be understood by a person skilled in the art that the above examples are only intended to be illustrative but not to limit the scope of the present invention.

The invention claimed is:

1. A passive radiator, comprising:

a radiating surface having a geometry providing a separation structure at an edge portion of the radiating surface and a first surface and a second surface with a vertical separation, wherein the separation structure is a step structure or a trench structure;

a primary suspension element whose inner diameter edge is connected to an upper level of the step structure on the first surface when the separation structure is the step structure, or connected to an upper edge of the trench structure on the first surface when the separation structure is the trench structure;

a secondary suspension element whose inner diameter edge is connected to a lower level of the step structure on the second surface when the separation structure is the step structure, or connected to a bottom of the trench structure on the second surface when the separation structure is the trench structure, wherein the separation structure provides a vertical separation of the primary and secondary suspension elements; and an enclosure, wherein the enclosure is a sound bar.

2. The passive radiator according to claim 1, further comprising:

an assembly ring, the primary suspension element having a second end connected to the assembly ring so that it is able to be connected to the enclosure through the assembly ring, and the secondary suspension element having a second end connected to the assembly ring so that it is able to be connected to the enclosure through the assembly ring.

3. A loudspeaker system, comprising:

a loudspeaker mounted in a first surface of the enclosure; and at least one passive radiator according to claim 1, which is mounted in a second surface of the enclosure.

4. The loudspeaker system according to claim 3, wherein the second surface is the same as or different from the first surface.

5. The loudspeaker system according to claim 3, wherein the second surface is a side surface of the enclosure.

6. The loudspeaker system according to claim 3, wherein the enclosure is of a long thin shape, the at least one passive radiator includes a plurality of passive radiators, and the plurality of passive radiators are mounted in the long surface of the enclosure.

* * * * *